US009362046B2

(12) United States Patent
Den Dulk

(10) Patent No.: US 9,362,046 B2
(45) Date of Patent: Jun. 7, 2016

(54) LUMINAIRE HAVING A CONNECTION DEVICE

(75) Inventor: Jacob Cornelis Paul Den Dulk, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 808 days.

(21) Appl. No.: 13/582,414

(22) PCT Filed: Feb. 4, 2011

(86) PCT No.: PCT/IB2011/050487

§ 371 (c)(1),
(2), (4) Date: Sep. 1, 2012

(87) PCT Pub. No.: WO2011/107897

PCT Pub. Date: Sep. 9, 2011

(65) Prior Publication Data

US 2012/0319497 A1 Dec. 20, 2012

(30) Foreign Application Priority Data

Mar. 3, 2010 (EP) ..... 10155356

(51) Int. Cl.

| | |
|---|---|
| ***H01F 38/14*** | (2006.01) |
| ***F21S 4/00*** | (2016.01) |
| ***F21V 23/02*** | (2006.01) |
| *F21Y 103/00* | (2016.01) |

(52) U.S. Cl.

CPC ..... *H01F 38/14* (2013.01); *F21S 4/008* (2013.01); *F21V 23/02* (2013.01); *F21Y 2103/00* (2013.01); *Y10S 439/95* (2013.01)

(58) Field of Classification Search

CPC ..... H01F 38/14; Y10S 439/95

See application file for complete search history.

(56) References Cited

U.S. PATENT DOCUMENTS

| | | | | |
|---|---|---|---|---|
| 328,712 | A | 10/1885 | Pennock | |
| 2,265,475 | A * | 12/1941 | Fodor | F21L 13/00 315/228 |

(Continued)

FOREIGN PATENT DOCUMENTS

| | | | |
|---|---|---|---|
| CN | 1433032 | A | 7/2003 |
| CN | 201122486 | Y | 9/2008 |

(Continued)

OTHER PUBLICATIONS

Bax, "Modelling of Inductive Properties of the Line-Output Transformer; Form Field-Line Pictures to Equivalent Circuits"; ISBN 90-386-0196-4, Jun. 7, 1995, pp. 1-209.

(Continued)

*Primary Examiner* — James Harvey

(74) *Attorney, Agent, or Firm* — Meenakshy Chakravorty

(57) ABSTRACT

A kit of parts (1) comprising an electric cable (3) comprising hermetically sealed electric conductors, a connection device (5) comprising a first (9*a*) and a second connection part (9*b*), the first and second connection part each comprising a cavity (12) in which a respective secondary conduction coil (14) is arranged and connected to respective electrical contacts. In a connected arrangement of the connection device and the electric cable, the wire is wound around both the first connection part in a first winding sense and around the second connection part in a second, opposite winding sense. Thus, a watertight electric connection between the cable and the connection device is established.

7 Claims, 2 Drawing Sheets

(56) References Cited

U.S. PATENT DOCUMENTS

| | | | | | |
|---|---|---|---|---|---|
| 4,186,432 | A * | 1/1980 | Hamacher | F21V 19/04 | 313/49 |
| 5,192,832 | A | 3/1993 | Rudy, Jr. et al. | | |
| 5,264,997 | A * | 11/1993 | Hutchisson | F21V 15/04 | 313/493 |
| 5,740,021 | A | 4/1998 | Lecheler et al. | | |
| 5,978,537 | A * | 11/1999 | Hosoi | G02B 6/4422 | 385/112 |
| 6,459,218 | B2 * | 10/2002 | Boys | E01F 9/065 | 315/236 |
| 6,731,071 | B2 * | 5/2004 | Baarman | A61L 2/10 | 315/248 |
| 7,408,324 | B2 * | 8/2008 | Baarman | H02J 7/025 | 320/108 |
| 7,518,952 | B1 | 4/2009 | Padden | | |
| 2004/0203262 | A1 * | 10/2004 | Lindsey | G01R 31/2884 | 439/66 |
| 2006/0176639 | A1 * | 8/2006 | Hunter | H01F 38/14 | 361/143 |
| 2010/0187972 | A1 * | 7/2010 | Wartofsky | H01J 61/327 | 313/493 |
| 2012/0313741 | A1 * | 12/2012 | Hall | H01F 38/14 | 336/118 |
| 2012/0319497 | A1 * | 12/2012 | Den Dulk | F21S 4/008 | 307/104 |
| 2014/0185298 | A1 * | 7/2014 | Kondo | G03B 15/03 | 362/265 |

FOREIGN PATENT DOCUMENTS

| | | | |
|---|---|---|---|
| EP | 0417542 | A1 | 8/1990 |
| EP | 1522759 | A2 | 4/2005 |
| EP | 2031300 | A1 | 3/2009 |
| FR | 2735309 | A1 | 8/1995 |
| WO | 03040612 | A1 | 5/2003 |

OTHER PUBLICATIONS

"3M" Insulation Displacement Connectors (IDCs); 3M Innovation (3M) See the URL-link below: http://solutions.3mnederland.nl/wps/portal/3M/nl_NL/EU__ElectricalMarkets/Home/ProductInfo/ProdCatalogue/?PC__7__RJH9U52300OH6023C9LDDR0SA1__nid=JW2MR6DQW0beWVSLQWG5JBgl; 3M Eltronic Prodcuts Division; 1999, pp. 1-8.

* cited by examiner

LUMINAIRE HAVING A CONNECTION DEVICE

FIELD OF THE INVENTION

The invention relates to a kit of parts comprising an electric cable and a connection device.

BACKGROUND OF THE INVENTION

In order to tap electricity or electric power from an electric cable, commonly an electrical split is made in said cable. Some solutions to create an electrical split make use of IDC contacts (Insulation Displacement Connections). Others use a gel to increase the watertightness (3M) See the URL-link below:
http://solutions.3mnederland.nl/wps/portal/3M/nl_NL/EU_ElectricalMarkets/Home/ProductI nfo/ProdCatalogue/?PC_7_RJH9U52300OH6023C9LDDR0SA1_nid=JW2MR6DQW0beW VSLQWG5JBgl.

Yet other solutions make use of induction coils to transport signals or current from the electric cable to the electric device. These induction coils are usually built in small pipes or donut-shaped cabinets, which have to be slid all over the cable to the desired position. A disadvantage of current electrical taps or splits is that cutting through the live, neutral or signal wires is necessary to create an electrical split, so that watertightness is no longer accomplished. Another disadvantage of the method of splitting electrical cable used nowadays resides in the envelope of the wire (which guides the electrical current) being pierced. This reduces the watertightness of the cable around the location of power transfer from cable to electric device. A third disadvantage may be the necessary preassembly of parts, for example induction coils shaped like tubes or donuts, which are able to behave as electrical taps, and which have to be slid over the cable. This is very unpractical when a cable has a length of a few meters or more.

SUMMARY OF THE INVENTION

It is an object of the invention to counteract at least one of the disadvantages of the known kit of parts. To this end the kit of parts as described in the opening paragraph comprises an electric cable comprising a respective hermetically sealed electric conductor, a connection device comprising at least one pair of a first and a second connection part, the first and second connection part each comprising an outer wall with a closed outer surface, said outer wall enclosing a cavity in which a respective secondary conduction coil is arranged, each secondary conduction coil being connected to respective electrical contacts; in a connected arrangement of the connection device and the electric cable, the wire is wound both around the first connection part in a first winding sense and around the second connection part in a second, opposite winding sense. This connection arrangement has the advantage that during operation energy transfer occurs from the wire to the connection device via conduction/induction while both the watertightness of the electrical cable/wire is maintained and, despite the cable/wire being wound around the connection parts, torsion in the cable/wire is essentially absent. Torsion is counteracted due to the fact that winding in the first winding sense and the torsion resulting therefrom is eliminated by winding in the second, opposite sense and the opposite torsion resulting therefrom. It is thus made possible to electrically connect an electric device, for example a luminaire, or a light source, to an already installed electrical cable/wire without degrading the watertightness of the electrical cable/wire, for example in that the cable/wire is cut or pierced by electrical contacts of the electric device.

In an embodiment, the kit of parts is characterized in that the electrical cable comprises a live wire and a neutral wire, each with a respective electric conductor, said wires being split/splittable from each other, with their respective electric conductor remaining hermetically sealed. The connection of only one wire is equally possible for an electric cable with a plurality of wires, for example two, three, four or more wires. Each wire is connectable to the connection device in an arrangement as described above, which connection device is provided, for this purpose, with a respective pair of first and second connection parts. To facilitate and better control winding of the wire around the connection parts, the kit of parts in a further embodiment is characterized in that said outer surface of each connection part has a spiral contour, the spiral contour on the first connection part being opposite to the spiral contour on the second connection part. The contour acts as a guide for attaining the correct winding arrangement of the wire around the connection parts.

To counteract unintended unwinding of the wire from the connection parts, the kit of parts in an embodiment is characterized in that the wire is held by at least one wire clamp. Preferably each wound wire is held by a respective wire clamp. To counteract unwinding and/or damage to the connection device as a result of mechanical load, for example in that the electrical cable/wire is subjected to pulling forces, the kit of parts is characterized in that each wire is held by at least two, for example three respective wire clamps. The arrangement of the clamps could, for example, be as follows: two of the three clamps for each wire are located on either side of both connection parts, and the one remaining clamp is located centrally, i.e. in between the first and the second winding sense, around the respective connection part.

To further facilitate connecting the wires to the connection parts, in particular the process of winding the wires around the connection parts, the kit of parts is characterized in that the connection parts protrude from the connection device. The connection parts are easily accessible by a user/installer. Preferably, the kit of parts is characterized in that the connection parts protrude from the connection device in a direction transverse to and/or along the electric cable. In particular, when the connection elements are arranged lengthwise along the electric cable, it is made possible to easily wind the wire simultaneously around both the connection parts, thereby facilitating installing/realizing the electrical connection and/or mounting.

The invention further relates to a connection device having all the characteristics of the connection device of the kit of parts as claimed in any one of the claims, and a lighting device, for example a luminaire, comprising such a connection device. Preferably said lighting device is characterized in that electrical connections in the connection device or the connection device and the lighting device are hermetically sealed from the environment. Thus, it is enabled to mount the lighting device comparably safely in moist/wet environments, for example in water basins, at offshore oil platforms, and thus to ensure that the risk of short-circuiting, electrocution is substantially absent.

BRIEF DESCRIPTION OF THE EMBODIMENTS

The features of the present invention can be best understood together with further objects and advantages by reference to the following description taken in connection with the accompanying schematic drawings, wherein like numerals indicate like parts. In the drawings:

FIG. 1 shows a perspective view of a first embodiment of a kit of parts according to invention;

FIGS. 2A-B show respectively a side view and a cross-section of an electric cable suitable for use in the kit of parts according to the invention;

DETAILED DESCRIPTION OF THE EMBODIMENTS

Figure 1:
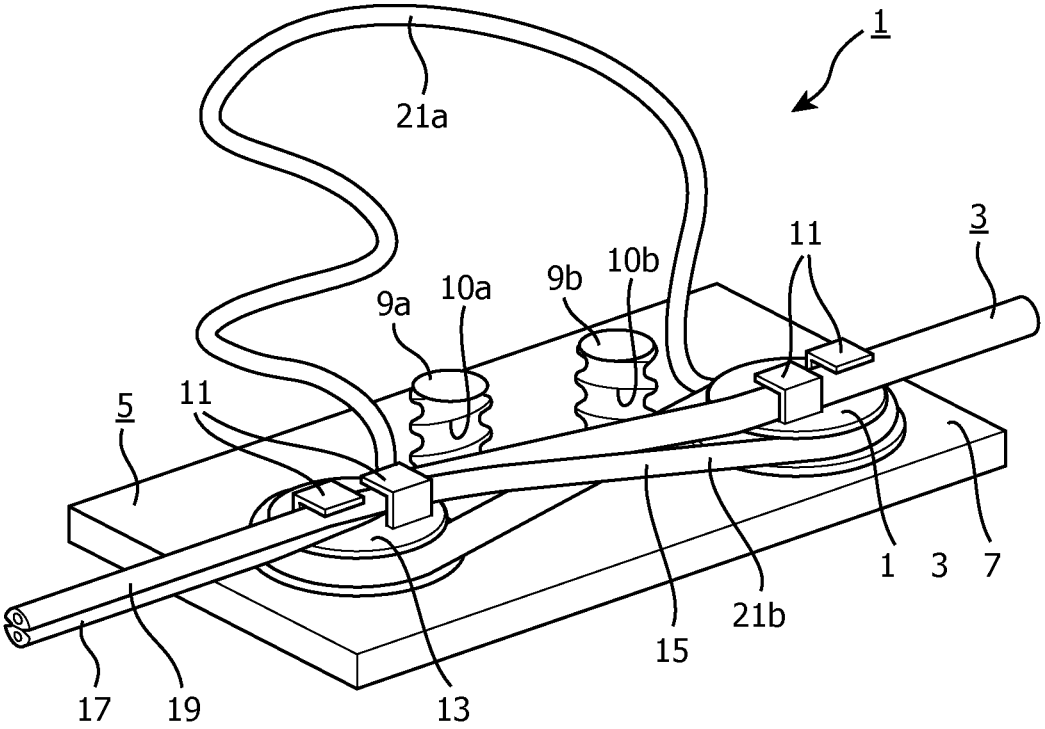

In FIG. 1 a kit of parts 1 in semi-mounted condition is shown in perspective view. The kit of parts 1 comprises an electric cable 3, and a connection device 5 to be built in and electrically connected to an electric device. The connection device comprises a base plate 7 with an internal wiring structure comprising electrical contacts (not shown), a first 9*a* and a second connection part 9*b*, four wire clamps 11, and a winding mechanism 13 to accommodate a surplus of electric wire 15 not wound around the connection parts. The connection parts are each provided with a respective spiral contour. The spiral contour 10*a* is clockwise for the first connection part and the spiral contour 10*b* is counterclockwise for the second connection part. In the mounted position, an electric wire wound around both connection parts 9*a*, 9*b* is not subjected to significant, permanent torsional forces. The electric cable has a live wire 17 and a neutral wire 19, each having a split off part 21*a*, 21*b*, respectively, at the location of the connection device, and the cable is fixed to the connection device in the four wire clamps mounted on the base plate accommodating, in between the clamps, the two connection parts. The split off part 21*a* of the live wire is still present as a free loop which is to be wound around the connection parts which extend in a transverse direction with respect to the electric cable and protrude from the base plate. The split off part 21*b* of the neutral wire is already mounted in the winding mechanism.

Figure 2A:
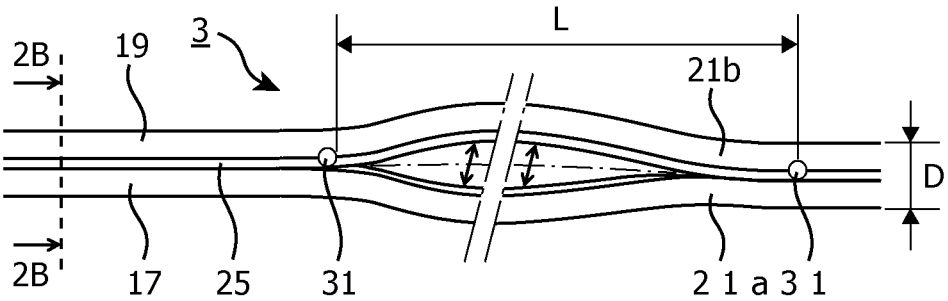
Figure 2B:
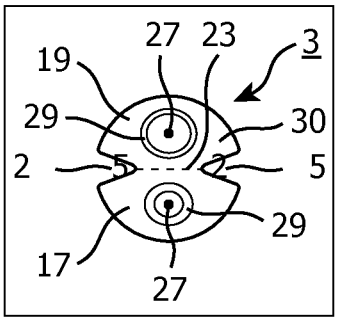

FIGS. 2A-B show respectively a side view and a cross-section of an electric cable 3 which is very suitable for use in the kit of parts according to the invention. The electric cable comprises a live wire 17 and a neutral wire 19 which are sealed to each other at an interface 23. To facilitate separating the live wire and the neutral wire from each other, a separator indentation 25 is provided at the interface and each wire comprises both an electric conductor 27 and a polyamide, for example an aramide, fiber/wiring, in the FIG. a Kevlar™ wiring 29, enveloped by a watertight sheathing 30. To counteract unintended further splitting of the electric cable, a plurality of rounded openings 31, in the FIG. two rounded openings 31, at a mutual distance L are provided at the interface of the wires, the split extending in between the rounded openings over the distance L. Practically, L is in the range of 10 times to 1,000 times the cross sectional diameter D of the cable, in the FIG. L≈120*D.

Figure 3:
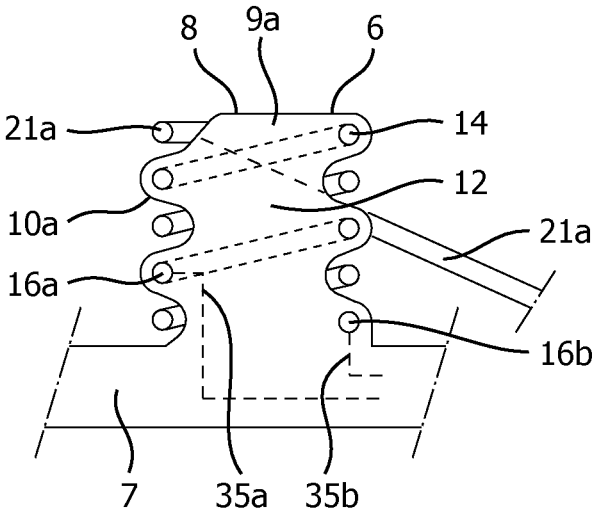
FIG. 3 shows a cross-section of a connection part of the connection device according to the invention.

FIG. 3 shows a longitudinal cross-section of a connection part 9*a* according to the invention, provided in a watertight manner on a base plate 7 of a connection device and protruding in a direction transverse thereto. The connection part has an outer wall 6 with a watertight outer surface 8 provided with a spiral contour 10*a* in clockwise direction, around which an electric wire 21*a* is wound. The outer wall 6 encloses a cavity 12 in which a secondary conduction coil 14 is arranged. The secondary conduction coil 14 has a winding beginning 16*a* and a winding end 16*b* via which it is connected both mechanically and electrically to respective electrical contacts 35*a*, 35*b* of an internal wiring structure of the connection device (not shown). These electrical contacts 35*a*, 35*b* are (to be) connected to an electric device. In this arrangement of wound electric wire 21*a* and secondary conduction coil 14, during operation with alternating high frequency current, for example a frequency in the range of 50 Hz to 3 MHz, energy is transferred from the electric wire to the connection device while the (original) watertightness of the separate parts, i.e. the electric wire and the connection device, is maintained.

Figure 4:
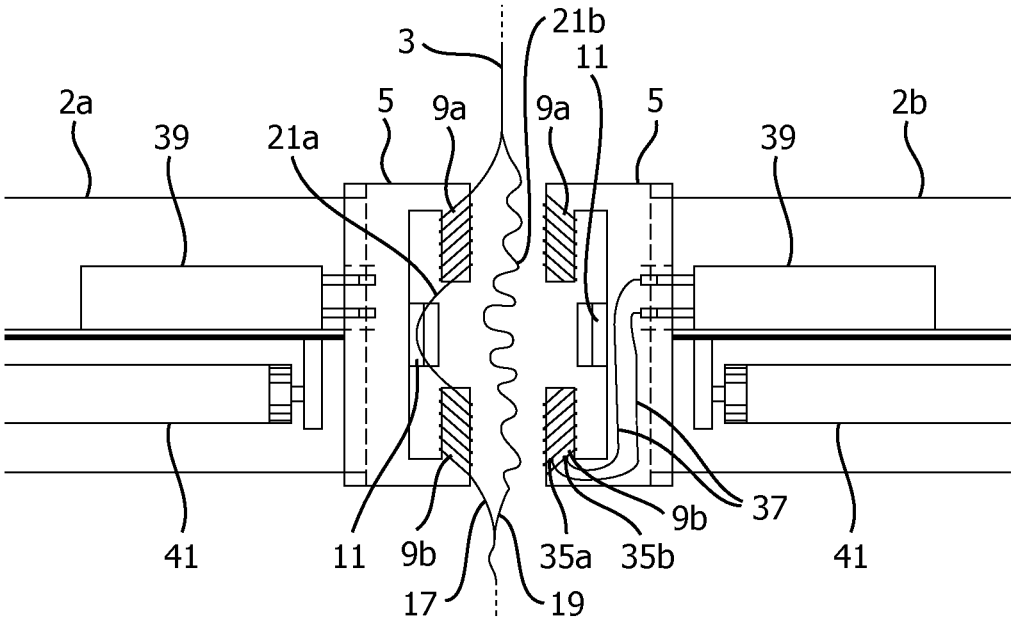
FIG. 4 shows two opposed luminaires to each of which there is sealed a connection device according to the invention.

FIG. 4 shows two watertight luminaires 2*a*, 2*b*, to each of which there is sealed in a watertight manner a respective connection device 5 according to the invention. The luminaires are arranged on either side of an electric cable 3 in a transverse direction with respect to the length direction of the cable. Each connection device has two connection parts 9*a*, 9*b* that protrude from the connection device and extend along the length direction of the electric cable. The electric cable has a live wire 17 and a neutral wire 19, each having a split off part 21*a*, 21*b*, respectively, at the location of the connection device. The live wire 21*a* is already wound around the respective connection parts 9*a*, 9*b* of the connection device 5 of luminaire 2*a* and is fixed to the connection device in wire clamp 11 to counteract spontaneous or undesired unwinding of the live wire. The split off part 21*b* of the neutral wire is still present as a free loop and is yet to be wound around the connection parts 9*a*, 9*b* of connection device 5 of luminaire 2*b*. Each connection device has electrical contacts 35*a*, 35*b* and internal wiring 37 via which the connection device is connected with an electric device 39, i.e. a circuitry of a luminaire, thus enabling a light source 41, in the FIG. a fluorescent lamp, to operate.

The invention claimed is:

1. A luminaire, comprising:

an electric cable comprising a respective hermetically sealed electric conductor, a connection device comprising at least one pair of a first and a second connection part, the first and second connection part each comprising an outer wall with a closed outer surface, said outer wall enclosing a cavity in which a respective secondary conduction coil is arranged, each secondary conduction coil being connected to respective electrical contacts, wherein, in a connected arrangement of the connection device and the electric cable, the wire is wound around both the first connection part in a first winding sense and around the second connection part in a second, opposite winding sense.

2. The luminaire as claimed in claim 1, wherein the electrical cable comprises a live wire and a neutral wire, each with a respective electric conductor, said wires being split/splittable from each other, with their respective electric conductor remaining hermetically sealed.

3. The luminaire as claimed in claim 1, wherein said outer surface of each connection part has a spiral contour, the spiral contour on the first connection part being opposite to the spiral contour on the second connection part.

4. The luminaire as claimed in claim 1, wherein the wire is held by at least one wire clamp.

5. The luminaire as claimed in claim 1, wherein the connection device comprises a plurality of pairs of first and second connection parts.

6. The luminaire as claimed in claim 1, wherein the connection parts protrude from the connection device in a direction either transverse to or along the electric cable.

7. The luminaire as claimed in claim 1, wherein the electrical connections in the connection device or the connection device and the lighting device are hermetically sealed from the environment.

* * * * *